US008435077B2

(12) United States Patent
Yang

(10) Patent No.: US 8,435,077 B2
(45) Date of Patent: May 7, 2013

(54) CARD EDGE CONNECTOR AND CONNECTOR ASSEMBLY THEREOF

(75) Inventor: Yong Teck Yang, Singapore (SG)

(73) Assignee: Molex Incorporated, Lisle, IL (US)

( * ) Notice: Subject to any disclaimer, the term of this patent is extended or adjusted under 35 U.S.C. 154(b) by 230 days.

(21) Appl. No.: 13/072,302

(22) Filed: Mar. 25, 2011

(65) Prior Publication Data

US 2011/0237101 A1 Sep. 29, 2011

(30) Foreign Application Priority Data

Mar. 26, 2010 (SG) ..... 201002095-6

(51) Int. Cl.
*H01R 24/00* (2006.01)

(52) U.S. Cl.
USPC ..... 439/637

(58) Field of Classification Search ..... 439/637, 439/61–62
See application file for complete search history.

(56) References Cited

U.S. PATENT DOCUMENTS

| | | | | |
|---|---|---|---|---|
| 5,366,382 | A * | 11/1994 | Thumma | 439/188 |
| 5,509,826 | A * | 4/1996 | White | 439/637 |
| 6,814,583 | B1 * | 11/2004 | Young et al. | 439/65 |
| 8,083,526 | B2 * | 12/2011 | Long | 439/60 |
| 8,328,567 | B1 * | 12/2012 | Yang | 439/157 |

* cited by examiner

*Primary Examiner* — Xuong Chung Trans
(74) *Attorney, Agent, or Firm* — Stephen L. Sheldon

(57) ABSTRACT

A card edge connector comprises an insulation housing and a plurality of terminals. The insulation housing includes a receiving slot for receiving a card module, a plurality of partitions arrayed on opposite sides of the receiving slot and defining a plurality of cavities, each partition including a bottom surface configured to be disposed on a printed circuit board. Each terminal comprises a body portion having a fixing portion configured to secure the terminal in the respective cavity and an inversely bent section, a solder tail extending from the fixing portion, and a contact portion extending from the inversely bent section and having a distal end at least partially protruding beyond the bottom surface.

16 Claims, 15 Drawing Sheets

CARD EDGE CONNECTOR AND CONNECTOR ASSEMBLY THEREOF

RELATED APPLICATIONS

This application claims priority to Singapore Application No. 201002095-6, filed Mar. 26, 2010, which is incorporated herein by reference in its entirety.

FIELD OF THE INVENTION

The present invention relates to a card edge connector and a connector assembly thereof, and more particularly, to a vertical card edge connector.

DESCRIPTION OF THE RELATED ART

A conventional vertical card edge connector 9, as shown in FIG. 1, is commonly used and adapted to electrically connect a vertically positioned card module to a mother board disposed on the card edge connector 9. The vertical card edge connector 9 includes an insulative housing 91, defined by two elongated side walls 911, having a card-receiving slot 92 with opposite sides along which a plurality of passageways 93 are arrayed, and a plurality of terminals 94, each having a contact portion protruding into the card-receiving slot 92, respectively received within the passageways 93.

The insulative housing 91 includes a module seating base 95 disposed below the card-receiving slot 92 and configured to engage the leading edge of the received edge portion of a card module. The module seating base 95 is positioned between the two elongated side walls 911, which are normally placed on a printed circuit board after the vertical card edge connector 9 is installed. When a card module is installed in the vertical card edge connector 9, the leading edge of the received edge portion thereof may seat on the module seating base 95. Therefore, the card module is separated from the printed circuit board by the height of the module seating base 95.

Such a vertical card edge connector 9 needs more vertical space for receiving an installed card module. As the consumer electronic apparatuses became more and more miniature, the height of a card module installed in a vertical card edge connector 9 becomes critical. One method to reduce the height of an installed card module is to reduce the height of the module seating base 95. However, the potential height reduction of the module seating base 95 is limited, and currently still unable to meet the ongoing miniature requirement of the modern electronic industry. Therefore, further improvements in a design of a vertical card edge connector would be appreciated by certain individuals.

SUMMARY OF THE INVENTION

In an embodiment, a card edge connector comprises an insulation housing and a plurality of terminals. The insulation housing includes a receiving slot for receiving a card module and a plurality of partitions arrayed on opposite sides of the receiving slot and defining a plurality of cavities. The insulation housing includes a bottom surface configured to be closely abutted on an upper surface of a printed circuit board. Each terminal comprises a body portion having a fixing portion configured to secure the terminal in the respective cavity and an inversely bent section, a solder tail extending from the fixing portion, and a contact portion extending from the inversely bent section and having a distal end at least partially protruding beyond the bottom surface of the insulation housing. The inversely bent section may extend downwardly at a bevel from an end of the fixing portion.

One embodiment of the present invention proposes a connector assembly, which comprises a printed circuit board including an open slot and the above-mentioned card edge connector disposed over the open slot.

BRIEF DESCRIPTION OF THE DRAWINGS

The invention will be described according to the appended drawings in which.

DETAILED DESCRIPTION OF THE INVENTION

Figure 1:
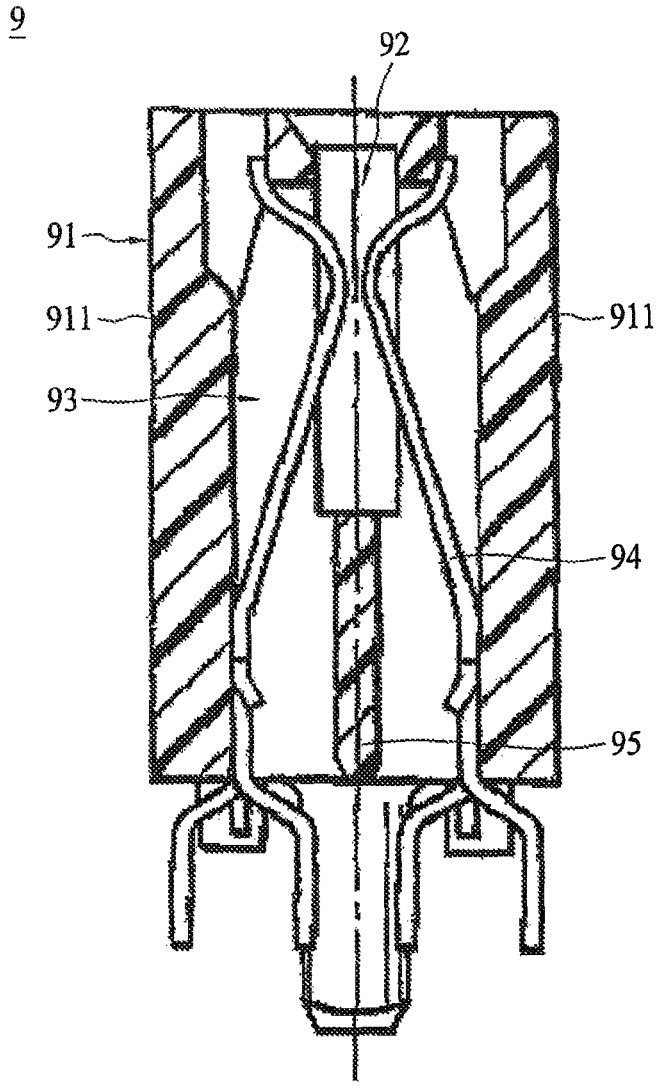
FIG. 1 illustrates a conventional vertical card edge connector.
Figure 2:
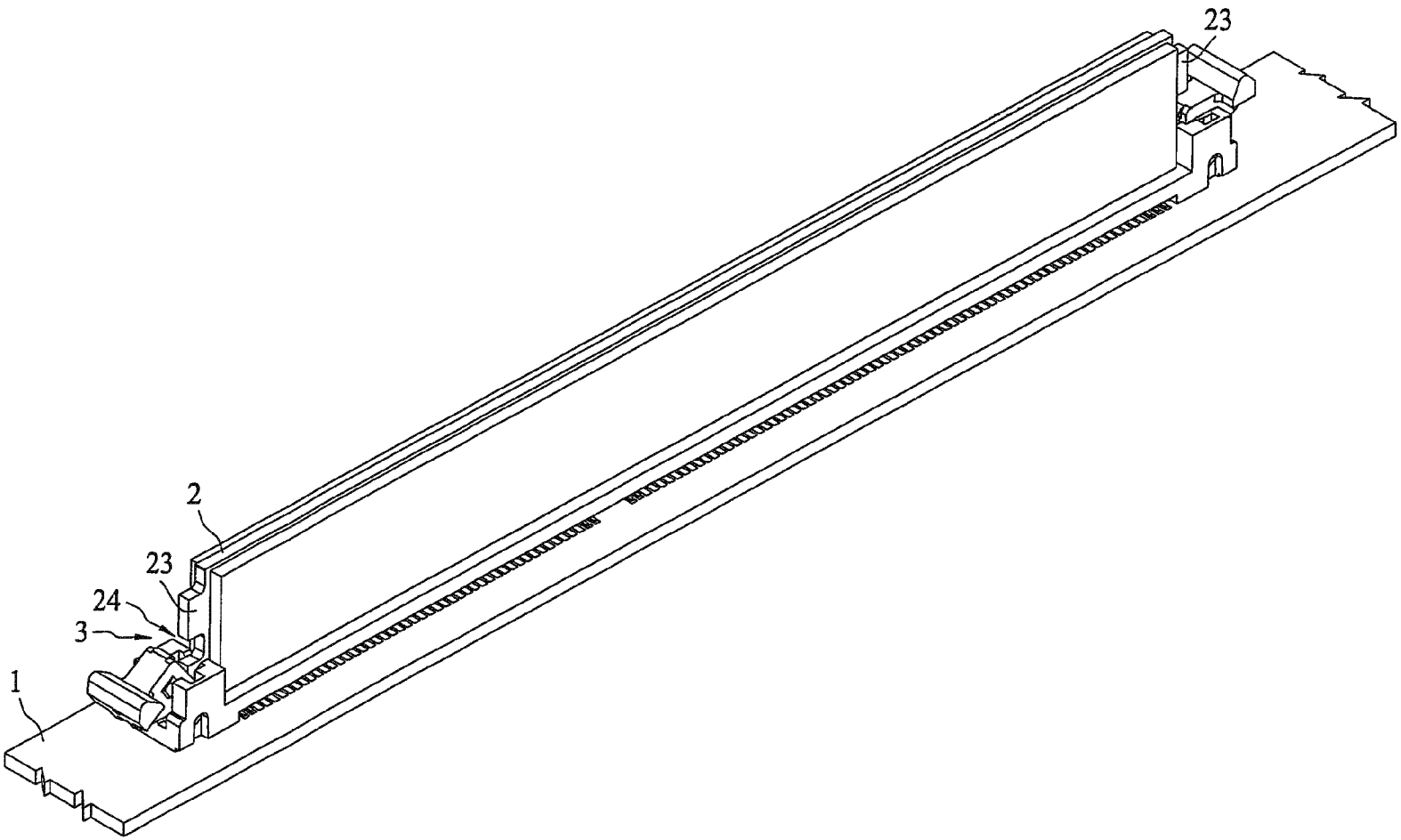
FIG. 2 is a perspective view showing an embodiment of a card edge connector mounted on a printed circuit board and receiving a card module.
Figure 3:
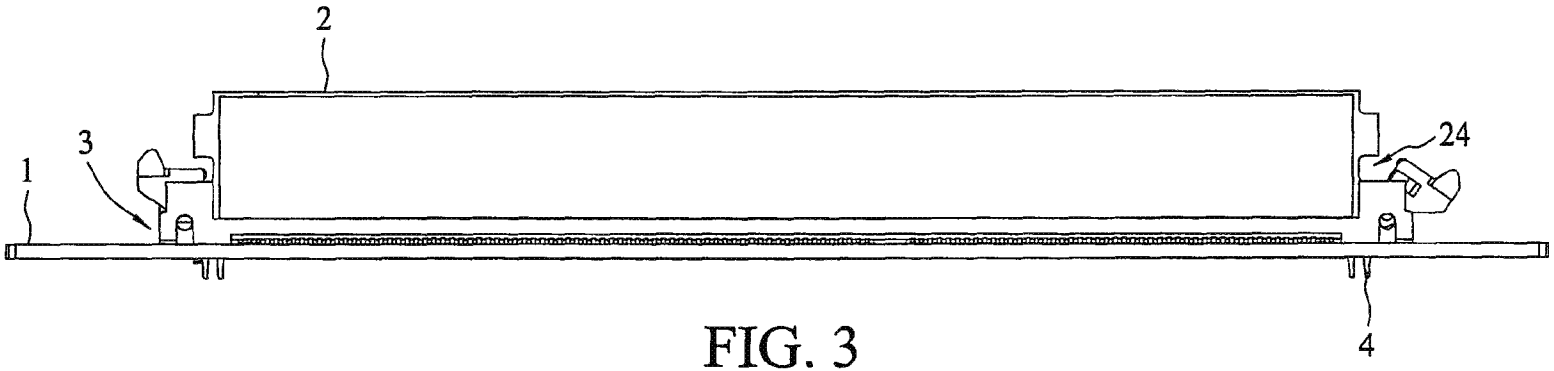
FIG. 3 is a front view of FIG. 2.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated, the depicted disclosure provides a new and improved card edge connector that can further lower module-seating plane. Additional benefits can be appreciated by the disclosure provided below.

Referring to FIGS. 2 to 5, a new card edge connector 3 that is mountable on a printed circuit board 1 and that can reduce the height of a card module 2 inserted into the card edge connector 3 is proposed. The card module 2 has an edge portion 21, along which a plurality of contact pads 22 are arrayed, and two side edges 23, on which a plurality of notches 24 are separately formed for locking.

Figure 4:
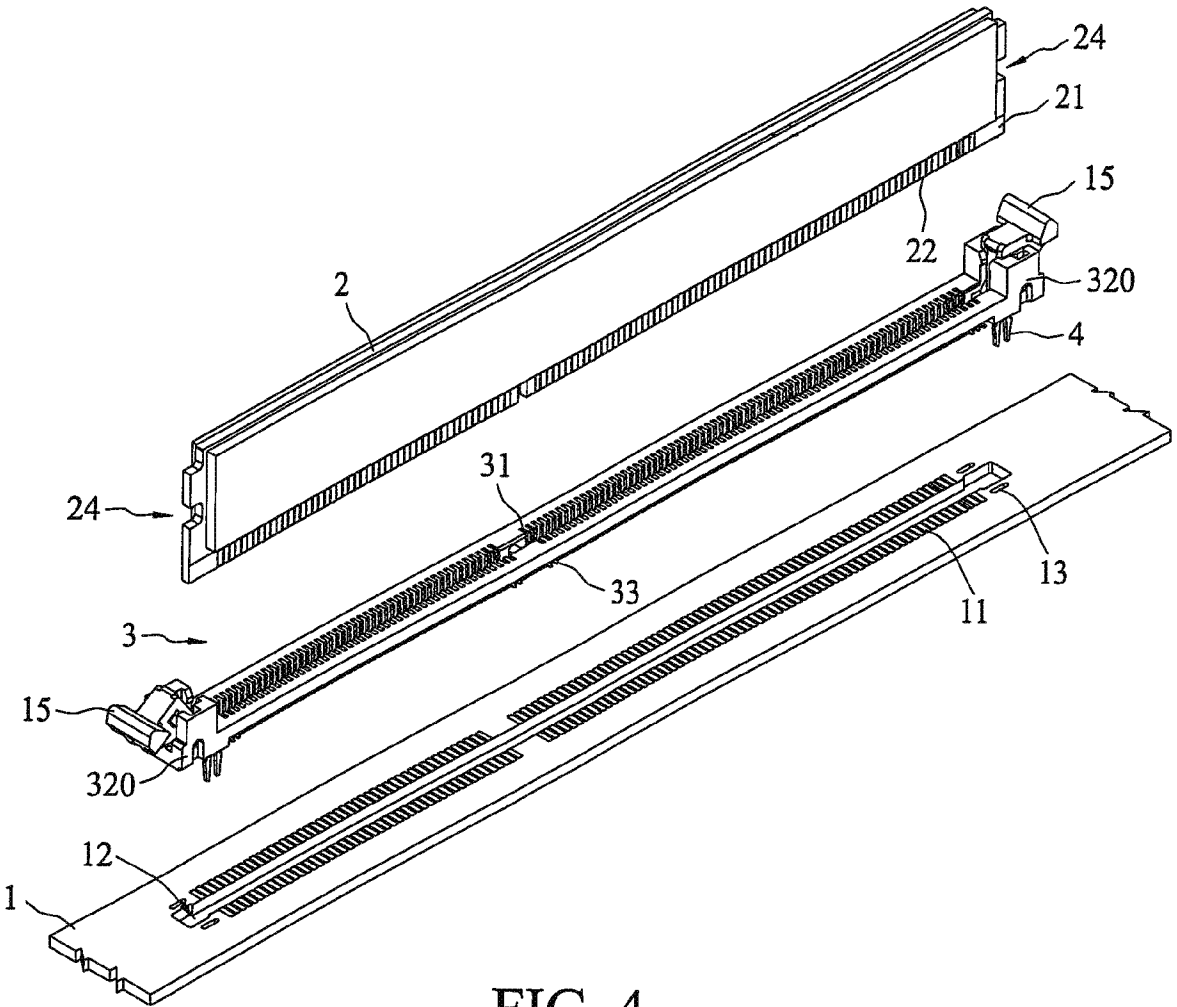
FIG. 4 is a perspective exploded view showing an embodiment of a printed circuit board, a card edge connector and a card module.
Figure 5:
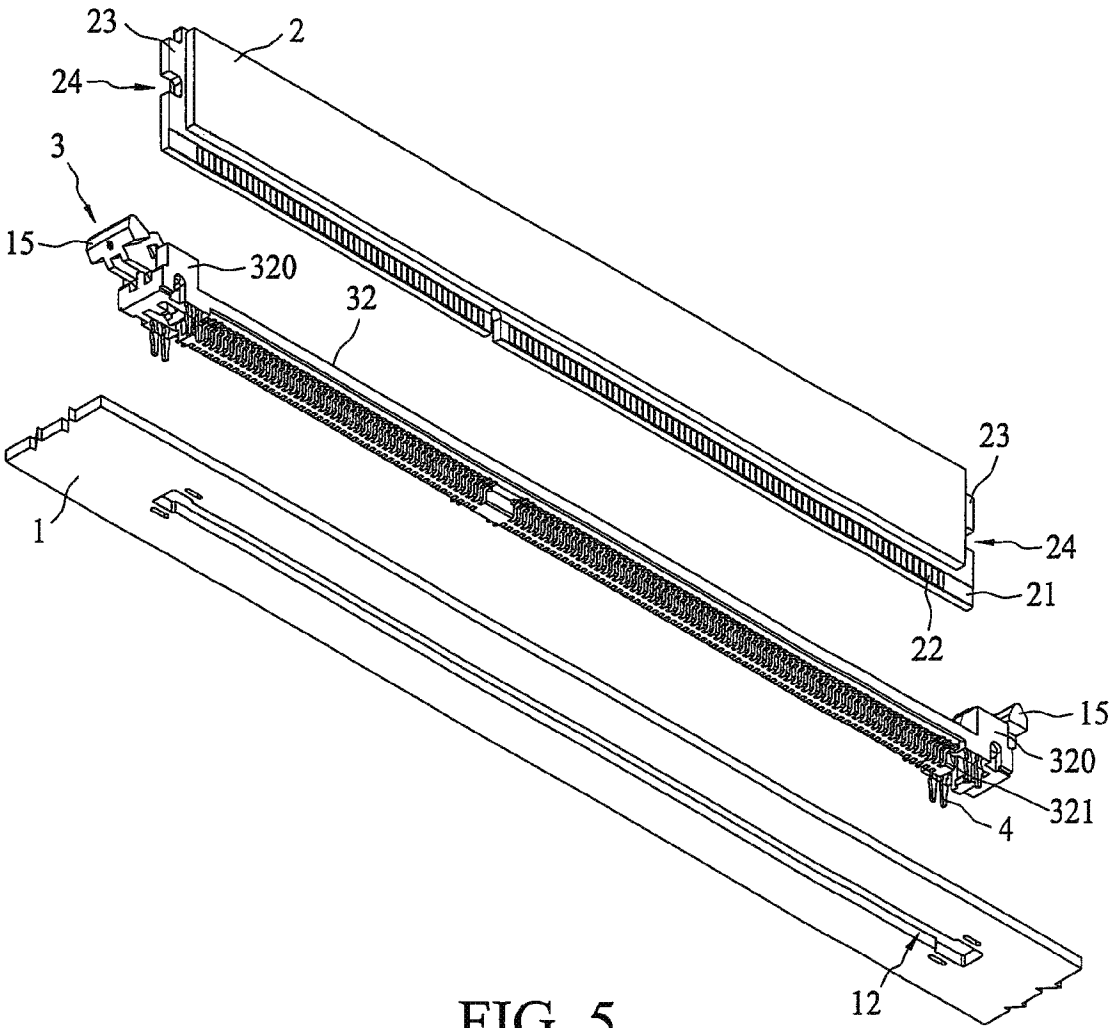
FIG. 5 is another perspective exploded view showing an embodiment of a printed circuit board, a card edge connector and a card module.
Figure 6:
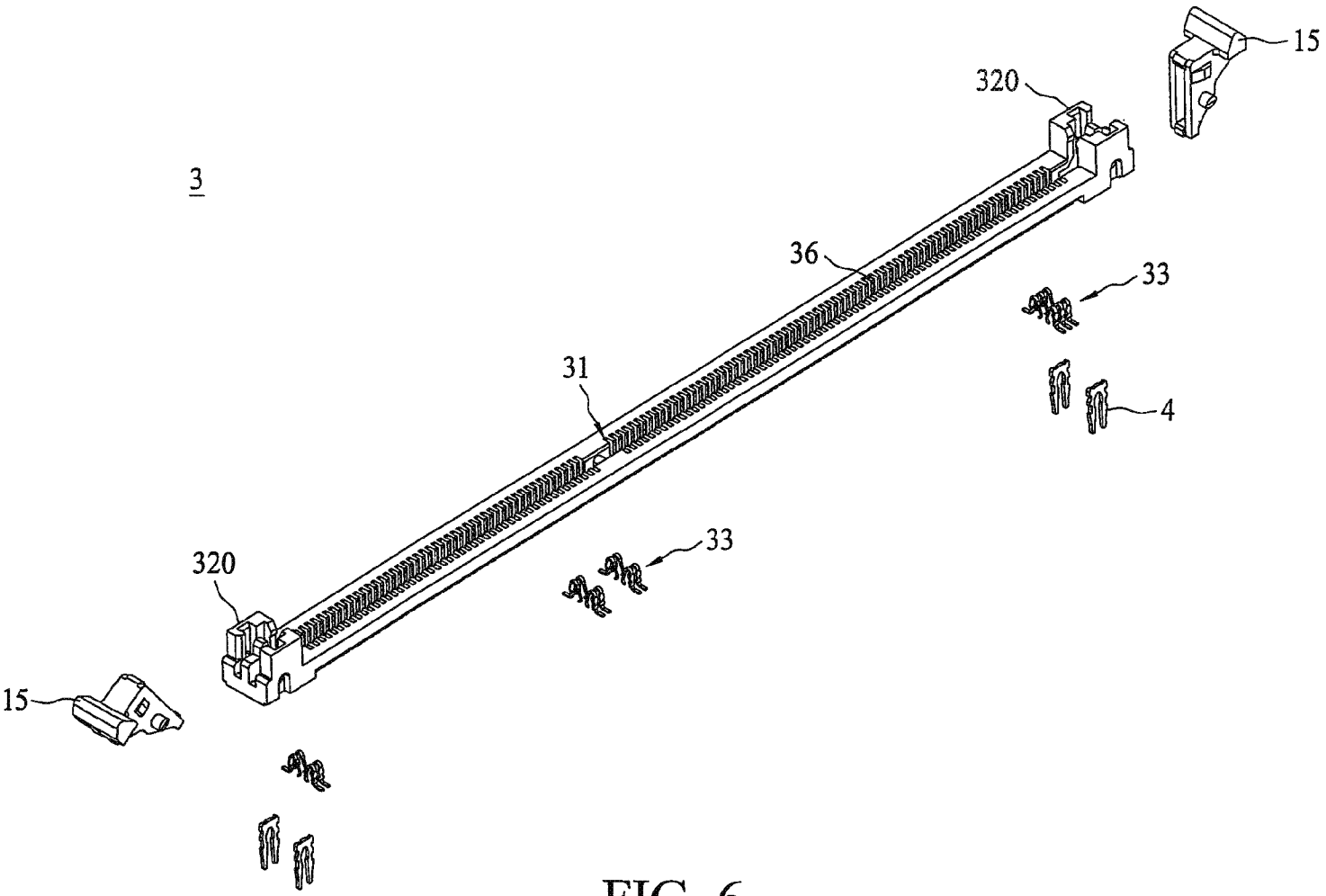
FIG. 6 is a perspective exploded view showing an embodiment of a card edge connector.

Referring to FIGS. 4 to 6, the card edge connector 3 may comprise an insulation housing 32 having two end portions 320 between which the receiving slot 31 extends, a plurality of terminals 33 arrayed within the insulation housing 32 and configured to electrically interconnect the contact pads 22 on the card module 2 and the contact pads 11 on the printed circuit board 1.

Figure 7:
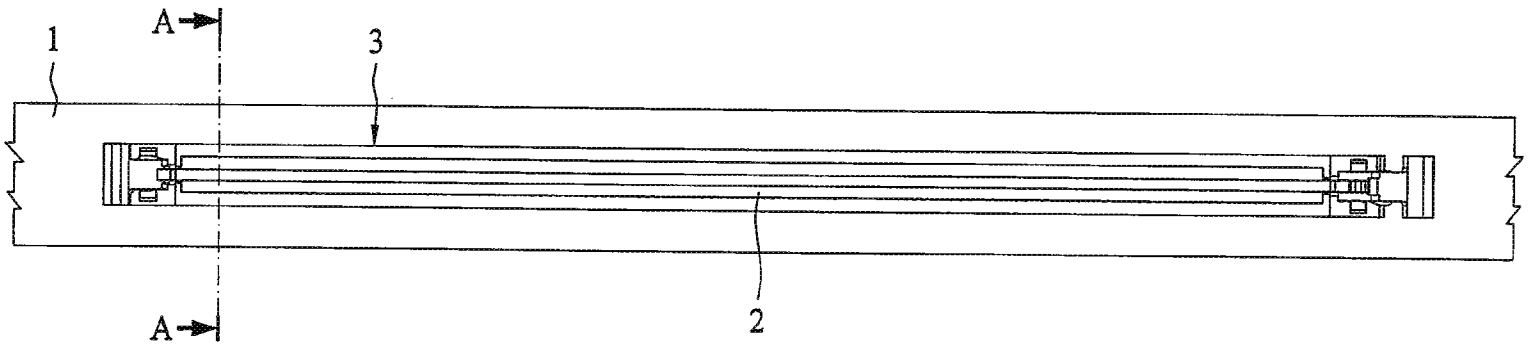
FIG. 7 is a top view of FIG. 2.
Figure 8:
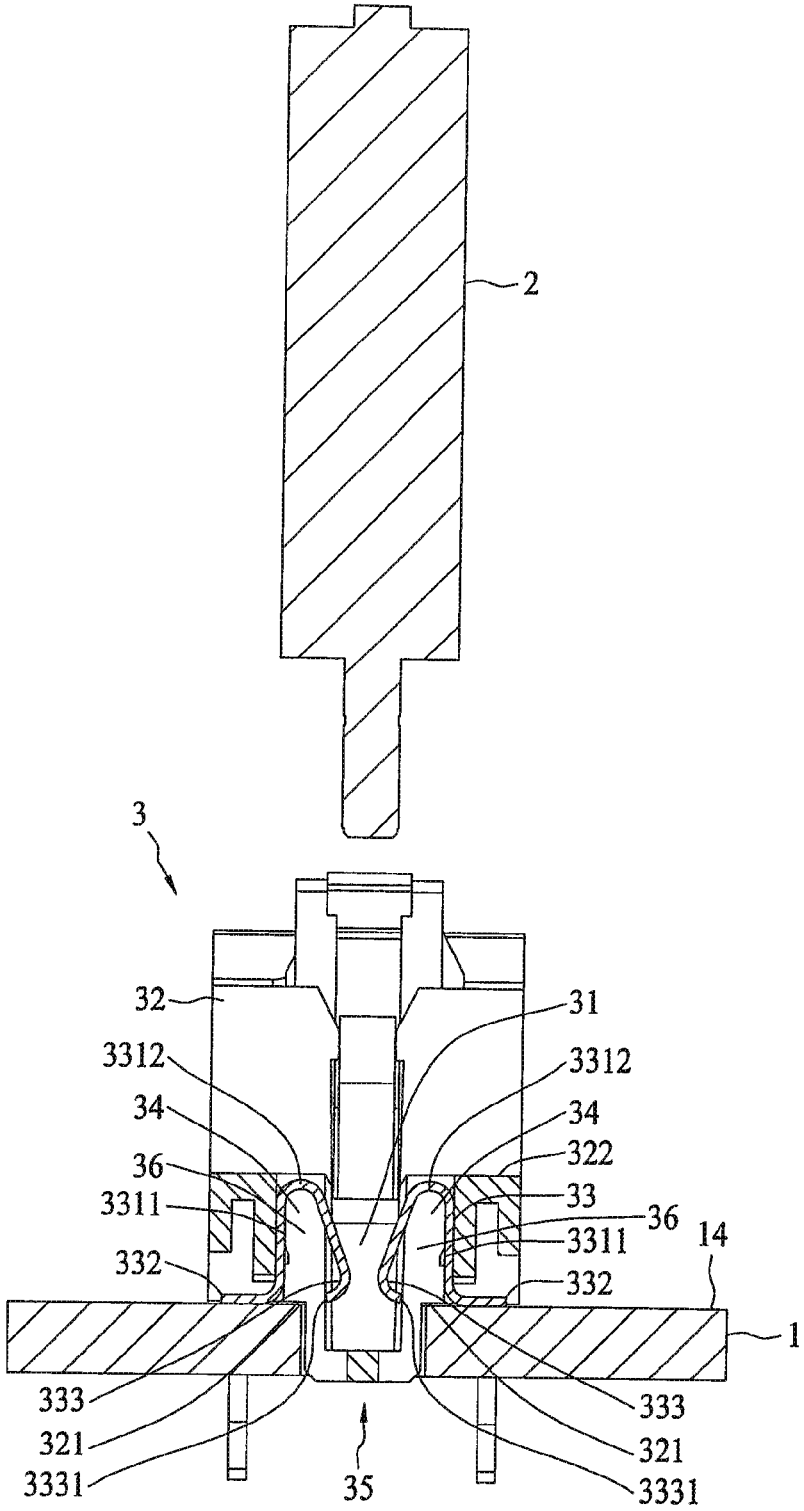
FIG. 8 is a cross-sectional view along line A-A of FIG. 7.
Figure 9:
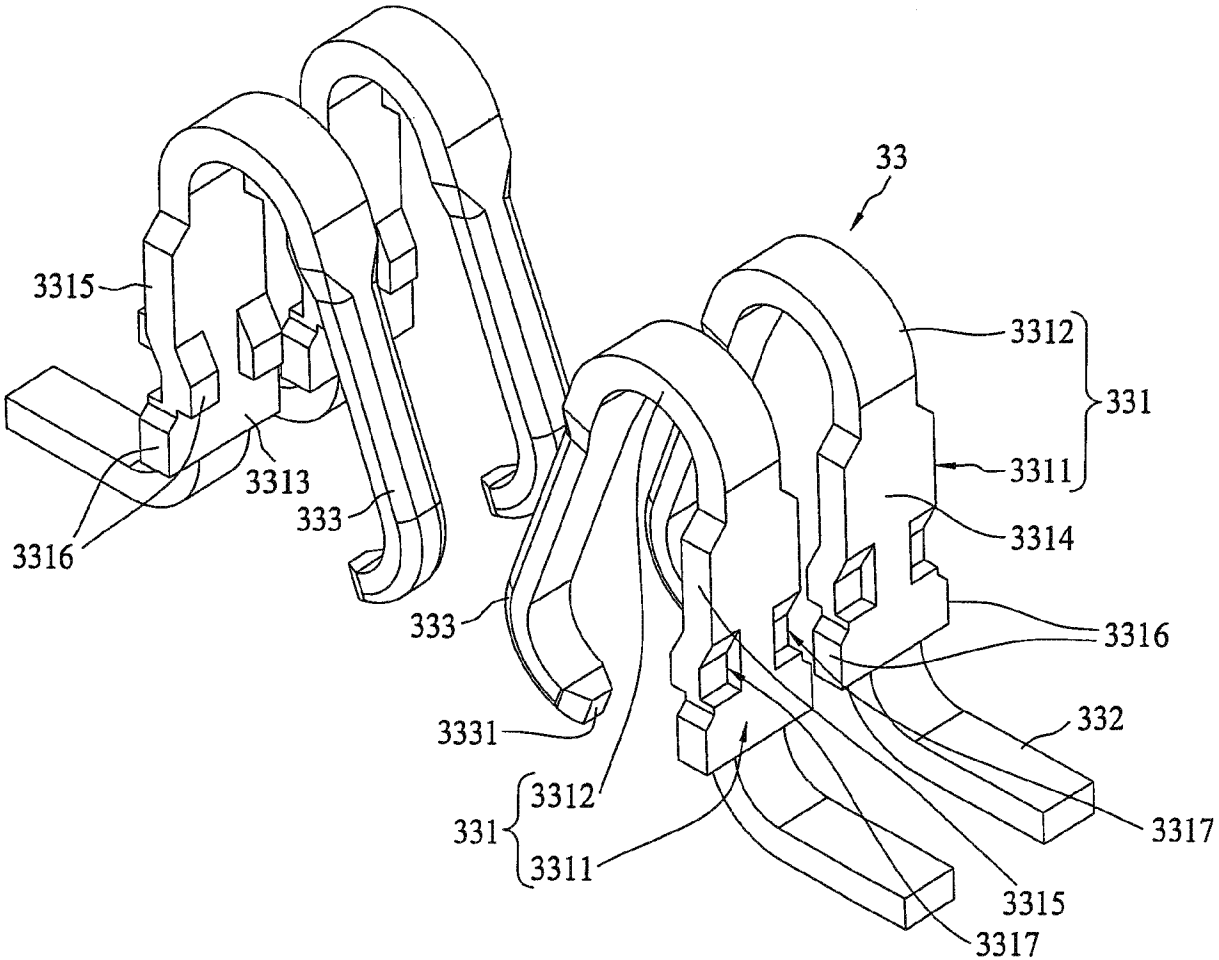
FIG. 9 is a perspective view showing an embodiment of a plurality of terminals.

Specifically, referring to FIGS. 6 to 8, the insulation housing 32 may comprise a plurality of partitions 36 arrayed along the opposite sides of the receiving slot 31, defining a plurality of cavities 34 configured to respectively receive the plurality of terminals 33. Referring to FIG. 9, each terminal 33 may comprise a body portion 331 having a fixing portion 3311 configured to secure the terminal 33 in the respective cavity 34 and an inversely bent section 3312 which extends downwardly at a bevel from an end of the fixing portion 3311, a solder tail 332 extending from another end of the fixing portion 3311, and a contact portion 333 extending from the inversely bent section 3312 and having a distal end 3331.

In particular, the fixing portion 3311 may have a plate-like shape, substantially defined by an inner main surface 3313, an outer main surface 3314, and two edge surfaces 3315. A plurality of protrusions 3316 can be separately formed on the inner main surface 3313 and two edge surfaces 3315 of the fixing portion 3311 of each terminal 33 for interference fitting with the respective cavity 34 in the insulation housing 32. In addition, a plurality of recessed areas 3317 can be formed on the outer main surface 3314 of each fixing portion 3311, corresponding to the protrusions 3316 on the inner main surface 3313.

Furthermore, in the present embodiment, the fixing portion 3311 of each terminal 33, as shown in FIG. 8, can extend vertically across the respective cavity 34. The inversely bent section 3312 is bent downwardly at a bevel so that a portion of the contact portion 333 can protrude into the receiving slot 31. The inversely bent section 3312 can have, but is not limited to, a curved shape as shown in FIG. 9. Referring to FIG. 8 again, the solder tail 332 of each terminal 33 can extend away from the receiving slot 31, and can extend horizontally relative to the printed circuit board 1 so that it can be soldered to the respective contact pad 11 in a surface mount manner.

Figure 11:
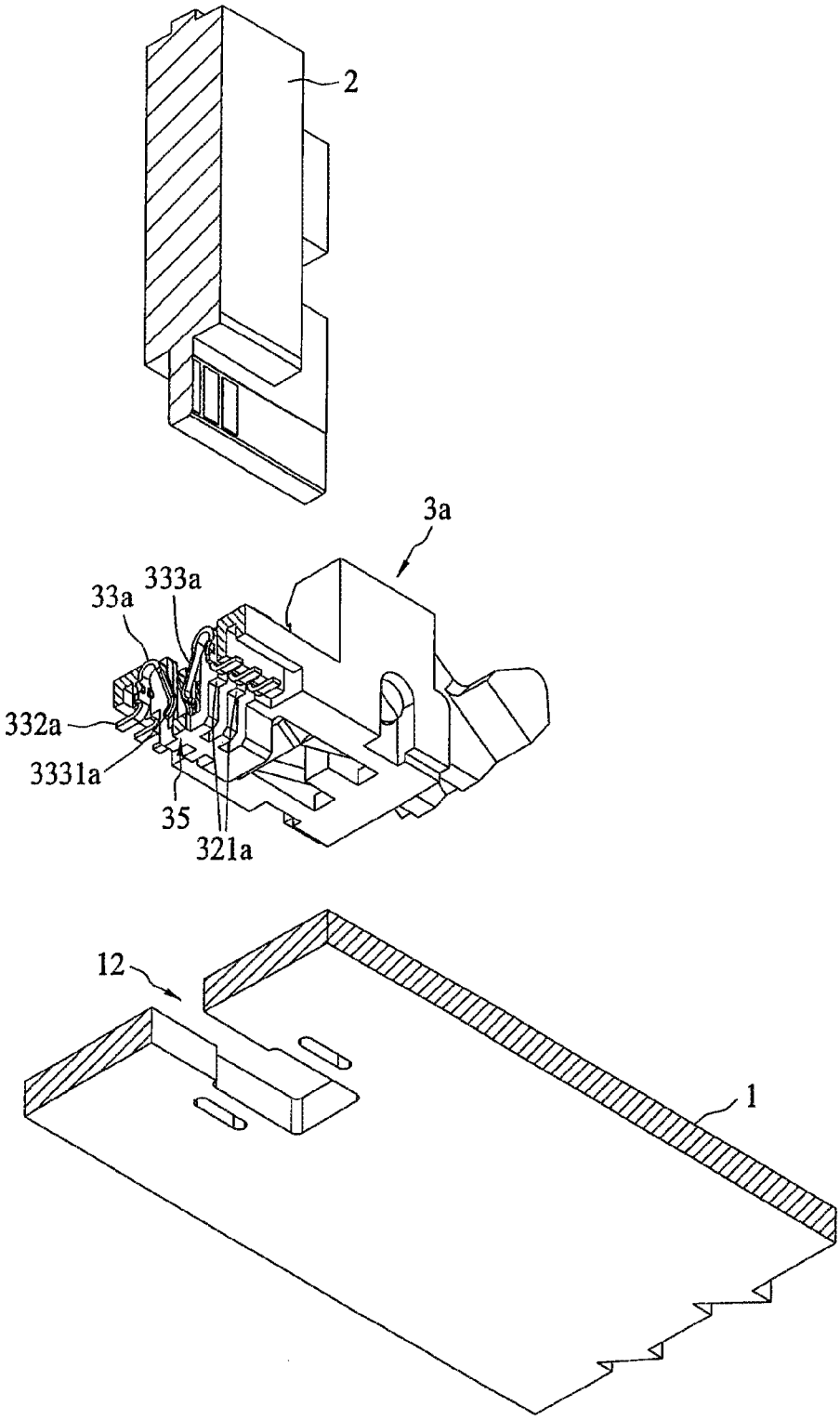
FIG. 11 is an exploded perspective view of FIG. 10.

More particularly, referring to FIGS. 5 and 8, each partition 36 includes a bottom surface 321, which is configured to be closely abutted on an upper surface 14 of the printed circuit board 1, when the card edge connector 3 is installed. The insulation housing 32 may further comprise a module seating base 35, which can protrude beyond the bottom surface 321 as shown in FIGS. 8 and 11 and can be configured to engage the leading edge of the edge portion 21 of the card module 2. Correspondingly, an open slot 12 can be formed on the printed circuit board 1 and can be configured to receive the module seating base 35 so that after the card edge connector 3 is installed on the printed circuit board 1, the bottom surface 321 of the insulation housing 32 is closely abutted on the printed circuit board 1 and the module seating base 35 protrudes into the open slot 12. Because the module seating base 35 is positioned below the bottom surface 321 or the upper surface 14 of the printed circuit board 1 where the card edge connector 3 is mounted, the height of the card module 2 protruding upward from the surface of the printed circuit board 1 can be significantly reduced.

In addition, in the embodiment of FIG. 8, to suitably engage the contact pads 22 on the card module 2, the position of each contact portion 333 protruding into the receiving slot 31 is disposed lower such that the distal end 3331 of the contact portion 333 will be at least partially below the bottom surface 321 or the upper surface 14 of the printed circuit board 1.

Figure 10:
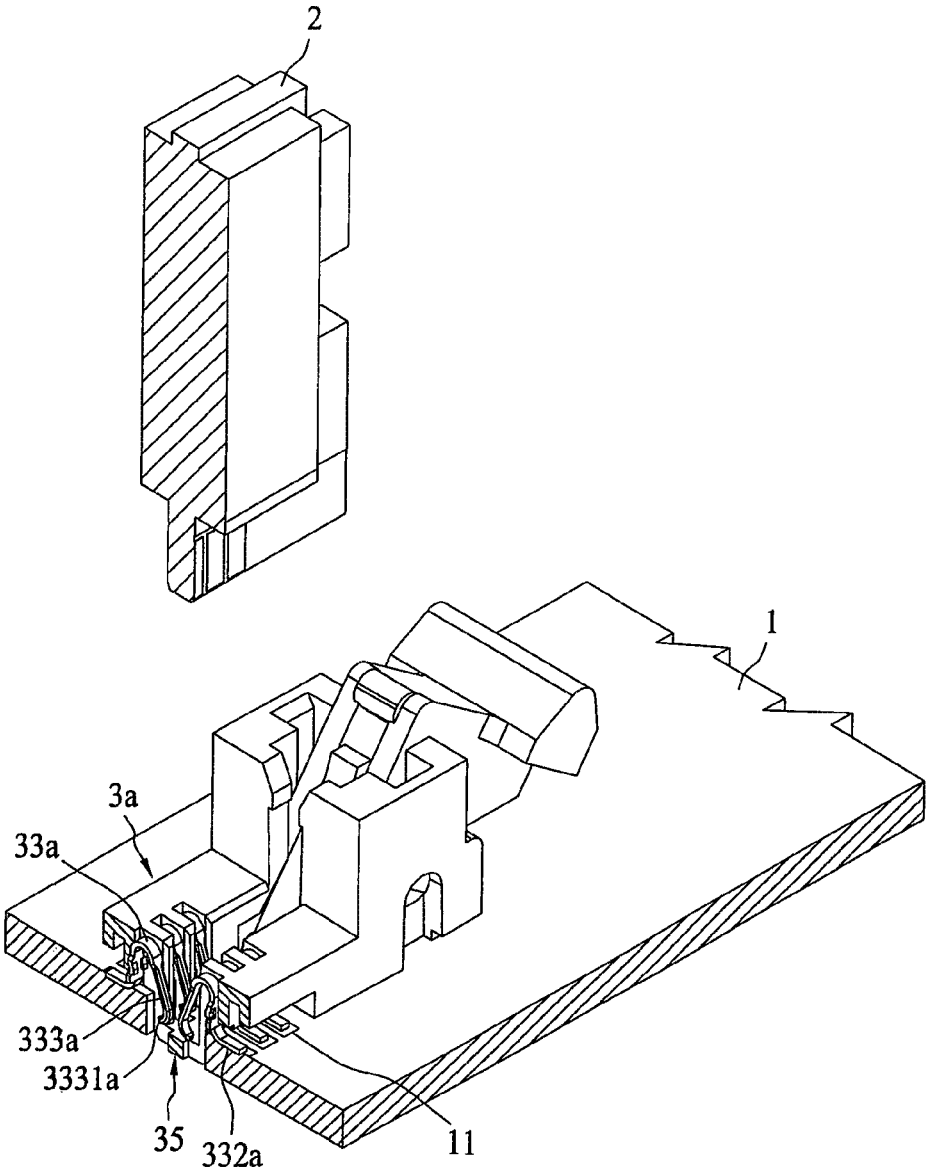
FIG. 10 is a perspective, sectional view showing another embodiment of a card edge connector mounted on a printed circuit board and a card module.
Figure 12:
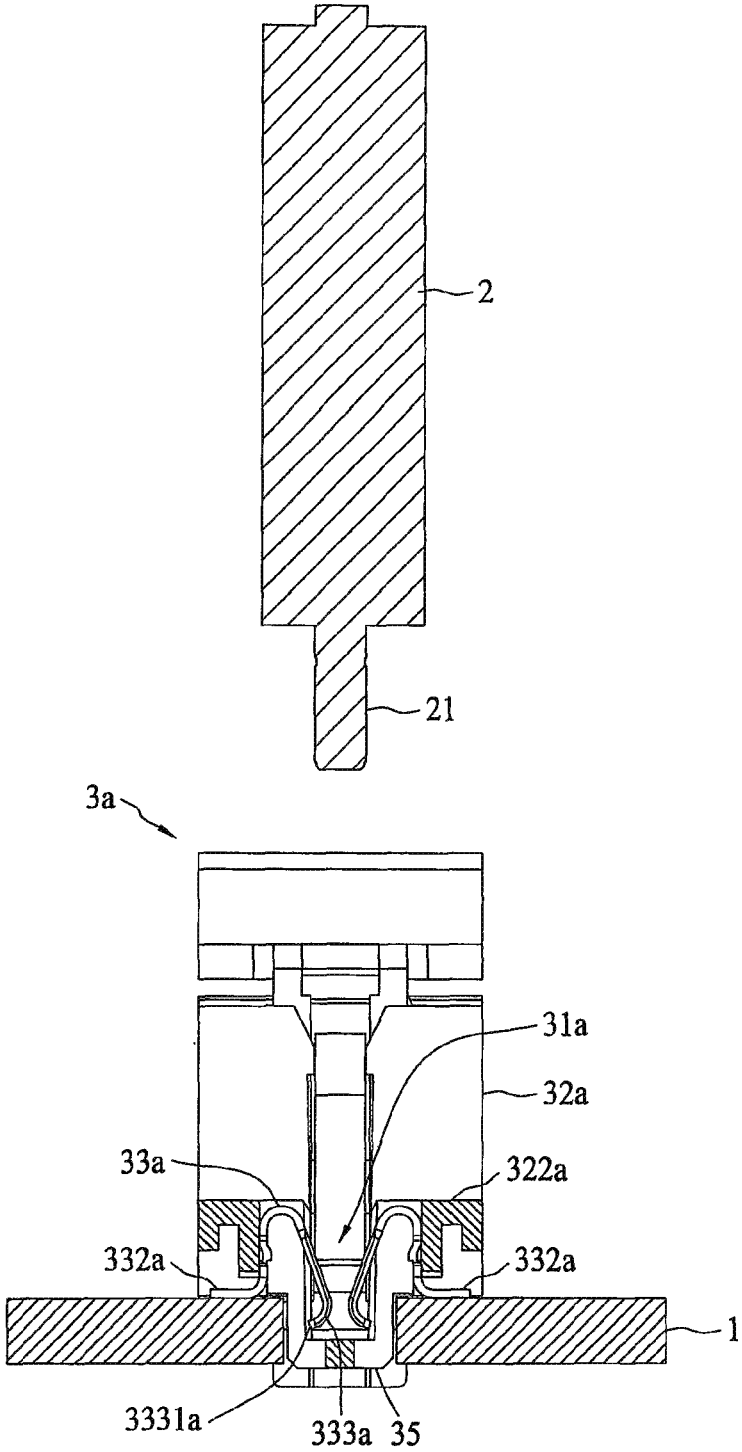
FIG. 12 is a side view of FIG. 10.

FIGS. 10 to 12 show a card edge connector 3*a* that can further reduce the height of a card module 2 protruding from the printed circuit board 1 according to a second embodiment. Compared to the embodiment of FIG. 8, the upper surface 322*a* of the insulation housing 32*a* can be lowered further so that the height of an inserted card module 2 can be further reduced. Respectively, the position of each contact portion 333*a* protruding into the receiving slot 31*a* is required to be disposed lower so that the distal end 3331*a* of the contact portion 333*a* of the terminal 33*a* will be below the bottom surface 321*a* which closely abutted on an upper surface 14 of the printed circuit board 1 or extend lower than the solder tail 332*a* as shown in FIG. 12.

Figure 13:
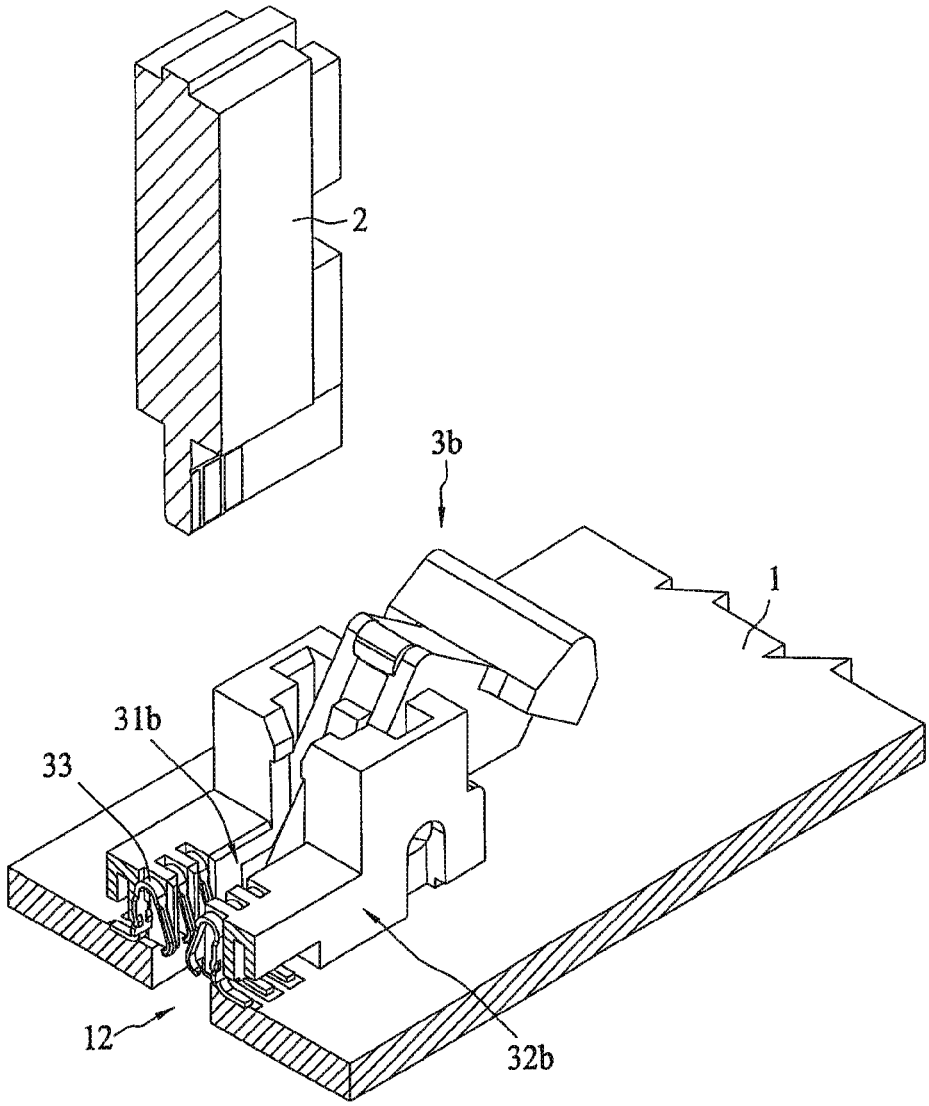
FIG. 13 is a perspective, sectional view showing another embodiment of a card edge connector mounted on a printed circuit board and a card module.
Figure 14:
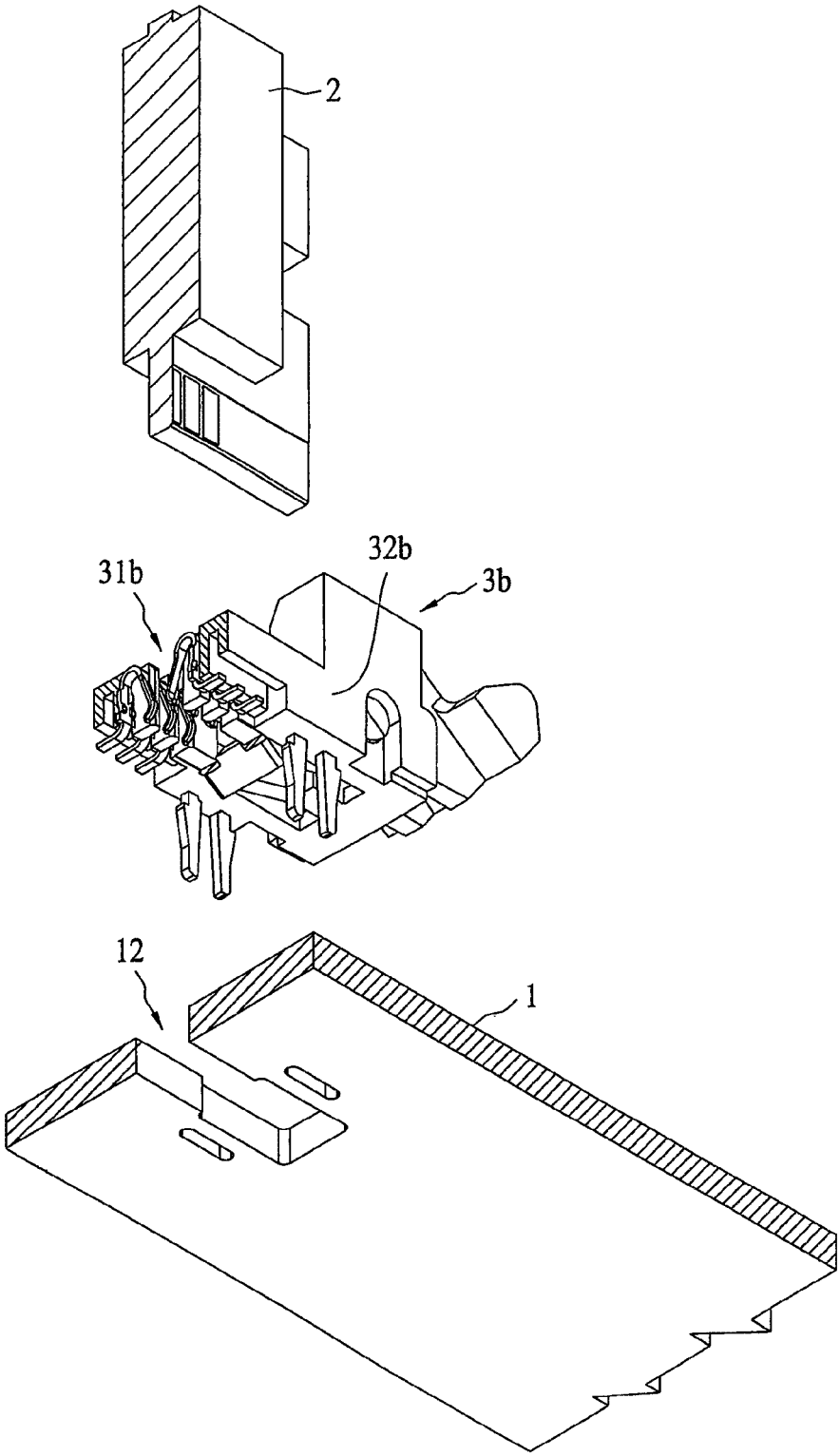
FIG. 14 is an exploded perspective view of FIG. 11.
Figure 15:
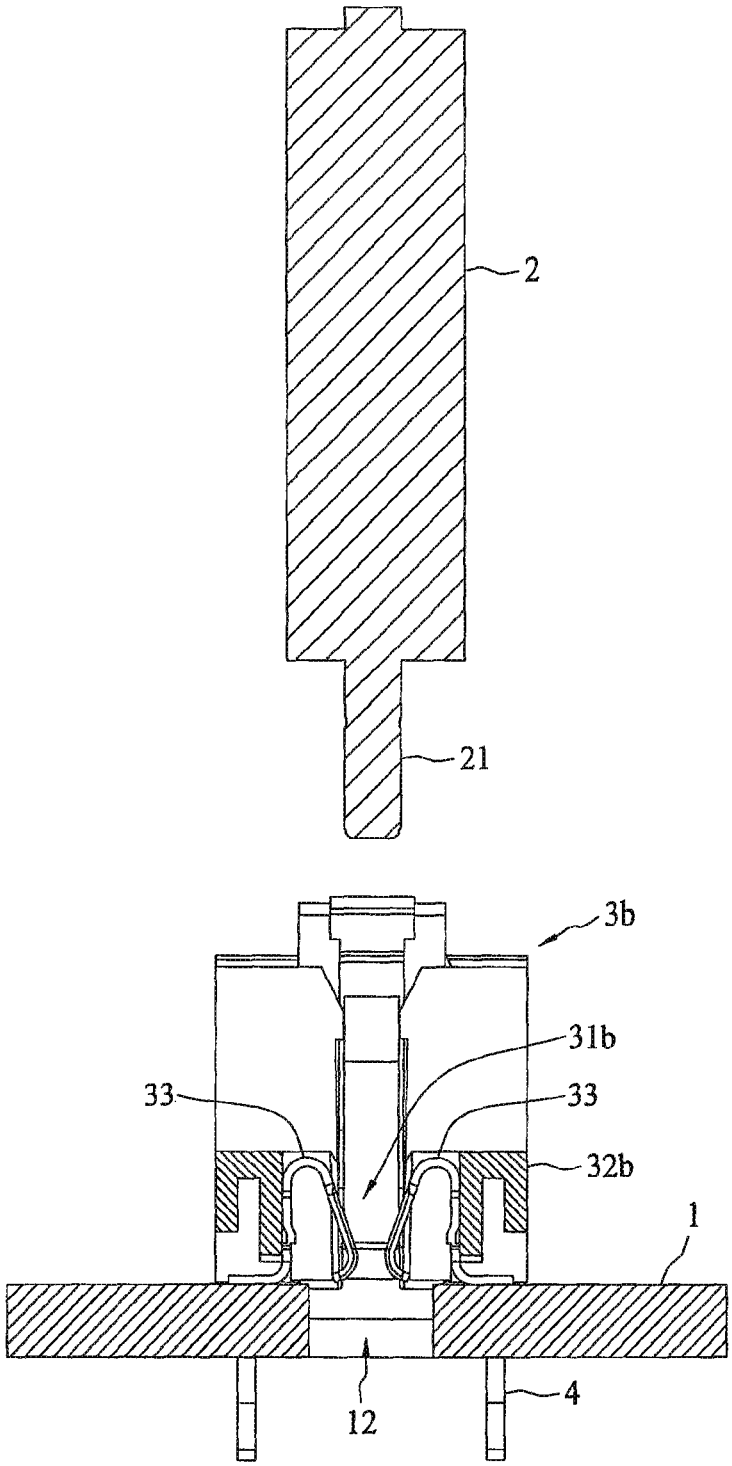
FIG. 15 is a side view of FIG. 13.

FIGS. 13 to 15 show the third exemplary card edge connector 3*b*. The card edge connector 3*b* may include a receiving slot 31*b*, which is configured to receive a card module 2 and is formed through the insulation housing 32*b*. Correspondingly, an open slot 12 may be formed with respect to the receiving slot 31*b* on the printed circuit board 1 so that after the card module 2 is inserted into the installed card edge connector 3*b*, the leading edge of the edge portion 21 of the card module 2 can pass through the receiving slot 31*b* and enter the open slot 12. As a result, the height of the card module 2 can be reduced or the card module 2 can have increased area to receive more electronic components. The module-seating base 35 as mentioned in the above two embodiments is omitted in this embodiment, and without the module-seating base 35, the usage of the card edge connector 3*b* can be more flexible.

Referring back to FIGS. 4 to 6, the card edge connector 3 can further comprise a plurality of board locks 4 disposed on the bottom of the card edge connector 3, and the printed circuit board 1 may include a plurality of holes 13 disposed corresponding to the board locks 4. The plurality of board locks 4 are configured to interference fit with the plurality of holes 13 so as to secure the card edge connector 3 to the printed circuit board 1. In addition, the card edge connector 3 can include a pair of latch/ejector assemblies 15 configured to be moved within the respective end portions 320 in a pivoting manner for ejecting the card module 2 or locking the inserted card module 2.

As can be appreciated, the second embodiment can provide a card edge connector that includes a module-seating base protruding beyond a bottom surface configured to be disposed on a printed circuit board so that the height of an inserted card module above the printed circuit board can be reduced. Correspondingly, the distal end of each of the terminals arrayed within the card edge connector can be disposed lower than the bottom surface or lower than the solder tail of a terminal. A third embodiment can provide a card edge connector that includes an insulation housing having a receiving slot for receiving a card module, and a printed circuit board that includes an open slot disposed with respect to the through slot. After a card module is inserted, the leading edge of the card module can enter the open slot so that the height of the card module above the printed circuit board can be significantly reduced.

The above-described embodiments are intended to be illustrative only. Numerous alternative embodiments may be devised by persons skilled in the art without departing from the scope of the following claims.

What is claimed is:

1. A card edge connector, comprising:

an insulation housing having a receiving slot for receiving a card module, a plurality of partitions arrayed on opposite sides of the receiving slot and defining a plurality of cavities, the insulation housing including a bottom surface configured to be closely abutted on an upper surface of a printed circuit board; and a plurality of terminals respectively received within the plurality of cavities, each terminal comprising:

a body portion having a fixing portion configured to secure the terminal in the respective cavity and an inversely bent section which extends downwardly at a bevel from an end of the fixing portion;

a solder tail extending out from another end of the fixing portion; and a contact portion extending from the inversely bent section and having a distal end at least partially protruding beyond the bottom surface of the insulation housing; wherein the printed circuit board including an open slot and the card edge connector disposed over the open slot.

2. The card edge connector of claim 1, wherein the distal end of the contact portion extends lower than the solder tail.

3. The card edge connector of claim 2, wherein the insulation housing further comprises a module seating base protruding beyond the bottom surface.

4. The card edge connector of claim 2, wherein the solder tail of each terminal extends horizontally relative to the printed circuit board.

5. The card edge connector of claim 2, further comprising a plurality of board locks for securing the insulation housing to the printed circuit board and two latch/ejector assemblies for latching and ejecting the card module, and the insulation housing comprising two end portions, wherein the plurality of board locks are disposed on the bottom of the insulation housing and the two latch/ejector assemblies are configured to move within the respective end portions in a pivoting manner.

6. The card edge connector of claim 2, wherein the fixing portion is defined by two edge surfaces and two main surfaces, and the fixing portion further comprises a plurality of protrusions respectively formed on one main surface of the fixing portion for an interference fit with the respective cavity.

7. The card edge connector of claim 2, wherein the receiving slot is formed through the insulation housing without a module seating base.

8. A connector assembly, comprising:

a printed circuit board including an open slot; and a card edge connector disposed over the open slot, comprising:

an insulating housing having a receiving slot for receiving the card module, a plurality of partitions arrayed on opposite sides of the receiving slot and defining a plurality of cavities, the insulation housing including a bottom surface configured to be closely abutted on an upper surface of the printed circuit board; and a plurality of terminals respectively received within the plurality of cavities, each terminal comprising a body portion having a fixing portion configured to secure the terminal in the respective cavity and an inversely bent section which extends downwardly at a bevel from an end of the fixing portion; a solder tail extending out from another end of the fixing portion; and a contact portion extending from the inversely bent section and having a distal end at least partially protruding beyond the bottom surface of the insulation housing.

9. The connector assembly of claim 8, wherein the distal end of the contact portion extends lower than the solder tail.

10. The connector assembly of claim 9, wherein the insulation housing further comprises a module seating base protruding beyond the bottom surface.

11. The connector assembly of claim 10, wherein the module seating base protruding in the open slot.

12. The connector assembly of claim 9, wherein the solder tail of each terminal extends horizontally relative to the printed circuit board.

13. The connector assembly of claim 9, further comprising a plurality of board locks for securing the insulation housing to the printed circuit board and two latch/ejector assemblies for latching and ejecting the card module, and the insulation housing comprising two end portions, wherein the plurality of board locks are disposed on the bottom surface of the insulation housing and the two latch/ejector assemblies are configured to move within the respective end portions in a pivoting manner.

14. The connector assembly of claim 9, wherein the fixing portion is defined by two edge surfaces and two main surfaces, and the fixing portion further comprises a plurality of protrusions respectively formed on one main surface of the fixing portion for an interference fit with the respective cavity.

15. The connector assembly of claim 9, wherein the receiving slot is formed through the insulation housing without a module seating base.

16. The connector assembly of claim 9, wherein the open slot is configured to receive a leading edge of the card module.

* * * * *